US007706716B2

(12) United States Patent
Tada et al.

(10) Patent No.: US 7,706,716 B2
(45) Date of Patent: Apr. 27, 2010

(54) IMAGE FORMING APPARATUS INCLUDING STRUCTURAL FRAME

(75) Inventors: Kaoru Tada, Tokyo (JP); Tadashi Okano, Tokyo (JP); Genta Hagiwara, Tokyo (JP); Nobuhiko Kita, Suita (JP); Kazuyoshi Kondo, Toyonaka (JP); Ryoh Idehara, Kawanishi (JP)

(73) Assignee: Ricoh Company, Ltd., Tokyo (JP)

( * ) Notice: Subject to any disclaimer, the term of this patent is extended or adjusted under 35 U.S.C. 154(b) by 201 days.

(21) Appl. No.: 11/898,038

(22) Filed: Sep. 7, 2007

(65) Prior Publication Data

US 2008/0075502 A1 Mar. 27, 2008

(30) Foreign Application Priority Data

Sep. 8, 2006 (JP) ..... 2006-243936

(51) Int. Cl.
*G03G 15/00* (2006.01)

(52) U.S. Cl. ..... 399/107

(58) Field of Classification Search ..... 399/107, 399/108, 110, 116, 117, 119, 121
See application file for complete search history.

(56) References Cited

U.S. PATENT DOCUMENTS 6,785,502 B2 8/2004 Kondoh
7,177,566 B2 * 2/2007 Noda et al. ..... 399/107
7,274,893 B2 * 9/2007 Morimoto et al. ..... 399/107
2003/0031483 A1 2/2003 Kondoh
2007/0110473 A1 5/2007 Kondo et al.
2007/0110475 A1 5/2007 Idehara et al.
2007/0166073 A1 7/2007 Idehara et al.

FOREIGN PATENT DOCUMENTS

JP 60-091044 5/1985
JP 2004-077788 3/2004
JP 2005-092025 4/2005

* cited by examiner

*Primary Examiner*—Hoan H Tran
(74) *Attorney, Agent, or Firm*—Harness, Dickey & Pierce, P.L.C.

(57) ABSTRACT

The present invention provides an image forming apparatus which prevents deformation of a structural frame caused by external force or weight of the apparatus itself, when set on a surface such as a conventional desk or floor, prevents image defects such as image deformation and the like without reducing the degree of accuracy of positioning support of respective printing devices inside the image forming apparatus, and furthermore also makes precise color matching possible while also being low price, easily assembled, compact, lightweight, highly reliable, and capable of obtaining high quality images. The structural frame of the image forming apparatus includes side wall portions made of resin and provided on either side of the apparatus, and at least two connectors formed from metal, for connecting the side wall portions, an image forming unit being supported by the side wall portions, and the connectors joining the side wall portions in substantially perpendicular and substantially horizontal directions.

6 Claims, 4 Drawing Sheets

IMAGE FORMING APPARATUS INCLUDING STRUCTURAL FRAME

BACKGROUND OF THE INVENTION

1. Field of the Invention

The present invention relates to an image forming apparatus such as a copying machine, facsimile apparatus, printer or the like.

2. Description of the Related Art

For this kind of image forming apparatus when a structural frame is composed of steel plate it is difficult to form a complex formation. As a result of this, often in addition to fastening together with screws or welding a plurality of steel plate parts to compose a strong structural frame, parts made of resin are further affixed as holding members to support positioning of the respective printing devices comprising the image forming apparatus. However, while in this kind of configuration a structural frame made of steel plate is advantageous in terms of strength and resistance to deformation, unfortunately, due to the large number of parts, in addition to an increase in weight, time and labor required for assembly is substantial, and manufacturing costs are increased. Moreover, due to the large number of parts, dimensional errors increase due to part combining, and in order to implement accurate positioning retention a high degree of accuracy is required for each and every part.

Conversely, composing a structural frame from resin has also been proposed. A structural frame formed from resin is lightweight and may be integrally formed in a complex formation. A structural frame of this kind is easily assembled, has few parts, and makes possible significant reductions in manufacturing costs. Moreover, as the structural frame is an integrated configuration, accurate positioning support for the respective printing devices is easily implemented. There are also examples, such as the invention disclosed in Japanese Patent Application Laid-open No. H09-222760, of monochrome image forming apparatuses in which assemblability is improved and manufacturing costs are reduced without compromising rigidity by using structural frames composed of an integrally formed resin and having a box-like shape with an open top surface.

However, resin is significantly less rigid than steel plate. In the case of color copying machines, which can obtain multicolor images, the structure for a structural frame is especially complex. As a plurality of developing devices filled with different color toners, an intermediate transfer device and the like must be embedded in the structural frame, a large space is required inside the structural frame, and this makes it extremely difficult to ensure rigidity. Furthermore, in a color copying machine, in order to clear out jammed recording medium, replace the respective printing devices and so on, a few large aperture portions are required in the structural frame for the attaching/detaching of parts. These aperture portions are not only required in the upper surface of an image forming apparatus, but also in the front, right and left surfaces, and in some cases the rear surface as well. These aperture portions are a cause of rigidity degradation in the structural frame. Moreover, as the releasing direction of a mold for resin molding used to form the structural frame is complex, the required degree of accurate positioning support becomes unobtainable.

The releasing direction of the mold for resin molding greatly influences the degree of accurate positioning support and manufacturing costs of the structural frame. It is necessary that the releasing direction of the mold be as simple as possible in order to ensure accuracy of the molded resin.

Accuracy of the molded resin is easily obtained by using a mold having two simple releasing directions, as the structure of such a mold is uncomplicated. However, the shapes that can be given to parts formed using such a mold are limited. It is possible to increase the releasing directions of the mold in order to integrally form complex parts by providing a slide core, which slides inwardly and outwardly, in addition to the above-described two simple releasing directions.

However, when used for continuous molding, the complex mold for this structure requires a longer than usual cooling time. Due to the complex structure, heat from the melted resin is retained and accumulates in the seams of the mold for the slide core and soon. As a result of this, often a longer amount of time is required than that which is ordinarily sufficient for the cooling and hardening of a melted resin. Although by making part formations complex, the provision of various functions and reduction of manufacturing costs are aimed for, unfortunately, as a result of the lengthening of molding time, conversely costs are increased.

Accordingly, when an image forming apparatus structural frame is to be made from molded resin, as the degree of accuracy required is high, if the part formations are made too complex, the previously described mold also becomes complex, resulting in the required degree of accuracy being unobtainable. Moreover, to obtain these part formations the time required for molding is lengthened and manufacturing costs cannot be lowered, resulting in a problem in terms of structural frame manufacturing costs. Additionally, there is a problem from the point of view of mold manufacturing lead-time, as in order to give parts the required degree of accuracy, the time for completion of a mold of complex configuration is lengthy. Furthermore, from the viewpoint of product development this means not being able to timely supply products the market is demanding. This lengthening of the development period in order to complete a mold of complex configuration is one of the most pressing issues the manufacturing industry faces.

In terms of strength of the structural frame, in recent years, image forming apparatuses and color image forming apparatuses as well, are rapidly becoming more lightweight and compact. However, the more compact and lightweight the main body of image forming apparatuses becomes, the higher the percentage of parts in which weight fluctuates during use, such as developing devices filled with toner, as well as recording medium such as paper and so on, and the higher the percentage of the amount of fluctuation of the center of gravity during use.

When considering the lowering prices of image forming apparatuses, a low cost material having the lowest level rigidity required, such as resin, and a configuration, such as an integral formation, should be chosen as a configuration for the structural frame, which supports positioning of the respective printing devices inside the image forming apparatus. However, in the image forming apparatus, even if weight balance is taken into consideration and the respective printing devices, driving device, power supply and such are set such that weight is not locally focused, due to the above-described fluctuation of the center of gravity, weight focuses in specific positions and due to loss of balance of the reaction force added to the feet from the installation surface, the load focuses on a specific foot. As a result of this, in a structural frame of a low rigidity using resin, deformation occurs and the degree of accuracy of positioning support is reduced, causing the generation of image defects. These problems become more prominent the more compact and lightweight image forming apparatuses become.

In order to solve these kinds of problems a method for increasing the rigidity of the structural frame by increasing the thickness of the plates and such may be considered. However this kind of method cannot be employed as adverse effects such as increase in cost and weight are caused by the increase in material used.

Accordingly, when a structural frame is made of resin (to be explained later with reference to the drawings), in order to support positioning of the respective printing devices with a high degree of accuracy as previously described, usually deformation of the structural frame is prevented by integrally forming from resin only side wall portions which are mutually parallel, perpendicular to the rotational central axes of the respective printing devices and which serve as means for positioning the respective printing devices, and one connector for connecting the side wall portions, and by using a plurality of highly rigid steel plate reinforcing members to attach the side wall portions.

In this configuration if a cross section is taken of the structural frame integrally formed with resin at the rotational central axes of the respective printing devices an H-like shape is formed. Also, the releasing directions of the mold are simply a vertical direction, and a horizontal direction outward from the side wall portions. Thus it is easy to obtain the required degree of accuracy for positioning support of the respective printing devices. However this kind of configuration is problematic in that, while the structural frame is integrally formed with resin, in addition to a large number of parts, and increase in weight, time and labor required for assembly is substantial, and as a result manufacturing costs are increased.

In order to deal with this problem a complex formation can be further given to the inner wall portions by configuring a slide core in the mold, which horizontally slides inside the side wall portions. However, due to the addition of the slide core the structure of the mold becomes complex, and as a result of the heat accumulation in the mold due to continuous molding as described previously, the required degree of accuracy cannot be obtained. Moreover, if the cooling time is lengthened in order to ensure accuracy, manufacturing costs are increased. Furthermore, time for completion of a complex mold leads to a lengthening of the manufacturing lead time and also results in an inability to timely provide products the market is demanding.

Consequently, for the realization of cost lowering of the image forming apparatus itself, the configuration of the structural frame is highly problematic from the viewpoints of strength, accuracy and cost lowering.

For example, in Japanese Patent Application Laid-open No. 2004-077788, an image forming apparatus is disclosed which houses and holds processing means in between a right and a left frame of a case, for visualizing an electrostatic latent image formed on an electrostatic latent image carrier with a developer stored on a developer carrier, and transferring the developer image on the electrostatic latent image carrier onto a recording medium. The right and left frames of this image forming apparatus are formed from a resin that does not include glass fibers.

In this image forming apparatus there are apertures in three directions, and metal stays are affixed to the right and the left resin frames substantially horizontally. Due to this the frame is of a weak configuration with regard to the twisting direction. In a monochrome image forming apparatus, as layering of colors does not take place, influence of twisting of the main body frame on images is minimal. However, as in a color image forming apparatus having a tandem system layering of colors takes place, the twisting of the main body frame is problematic and directly results in color misalignment, and causes print quality to significantly deteriorate.

In Japanese Patent Application Laid-open No. 2005-77735 a frame structure is disclosed which serves as the framework of an image forming apparatus for forming images on recording material. This frame structure comprises a transport body functioning as a transport path which originates at recording material supplying means for supplying the recording material in the apparatus, and from there by way of transfer means for transferring a visual image to the recording material leads up to fixing means for fixing the visual image on the recording material onto the recording material. The frame structure further comprises a pair of side plates positioned facing either side of the transport body, a connecting member for connecting the side plates on sides facing the transport body, and a rectangular bottom plate. The frame is formed by mounting the transport body, the connecting member, and the bottom plate each at different directions on the side plates.

However, the above-mentioned method is problematic in that the number of parts of the image forming apparatus is large, and as such the cost of the mold and so on is increased. Moreover, there are problems of assembly errors which occur when mounting positioning parts of the respective units on both steel plate side plates. Furthermore, as tolerance stack-up is large, and as a transport device is connected to the frame, when removing a jam, fastening parts must be removed from the rear surface of the machine body.

SUMMARY OF THE INVENTION

The present invention was conceived with reflection on the above problems. An object of the present invention is to provide an image forming apparatus which prevents deformation of a structural frame caused by external force or weight of the apparatus itself, when set on a surface such as a conventional desk or floor, prevents image defects such as image deformation and the like without reducing the degree of accuracy of positioning support of respective printing devices inside the image forming apparatus, and furthermore also makes precise color matching possible while also being low price, easily assembled, compact, lightweight, highly reliable, and capable of obtaining high quality images.

In an aspect of the present invention, an image forming apparatus comprises an image forming unit for forming an image on a recording medium; and a structural frame for supporting said image forming unit. The structural frame includes sidewall portions formed from resin and provided on both sides of the image forming apparatus, and at least two connectors formed from a metal, for joining the side wall portions. The image forming unit is supported by the side wall portions, and the connectors join the side wall portions insubstantially perpendicular and substantially horizontal directions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
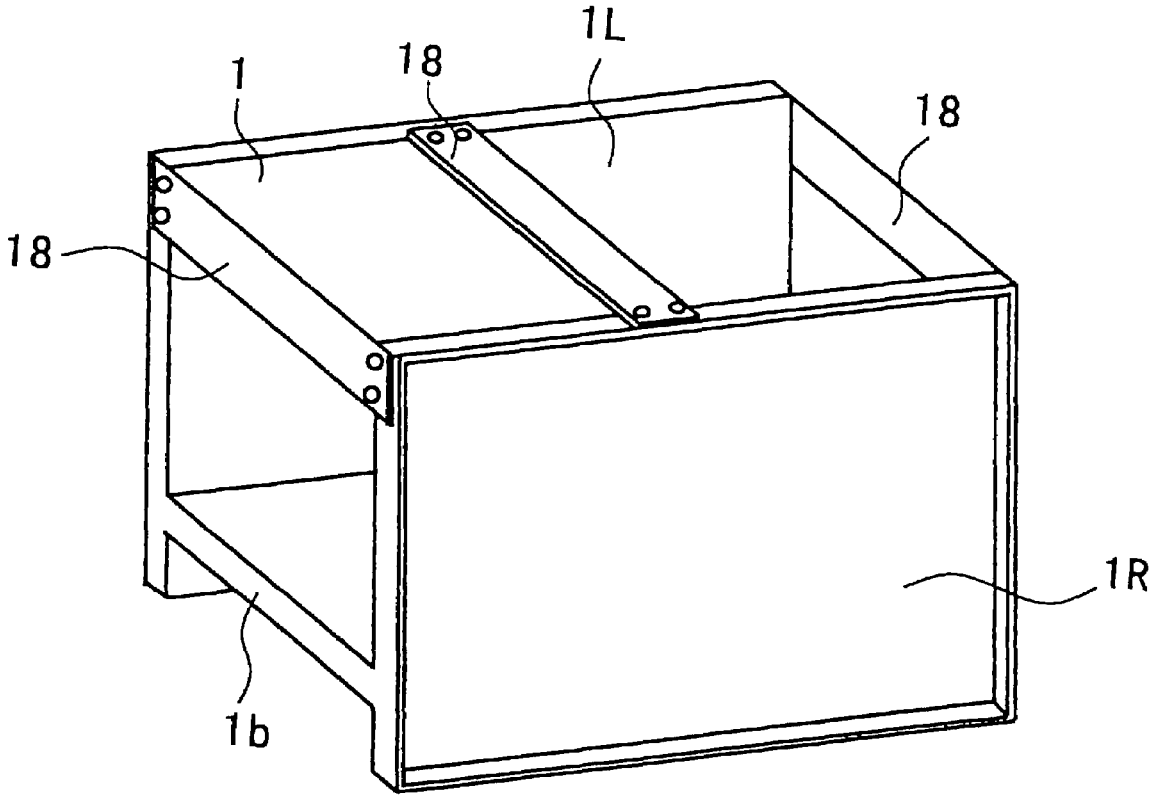
FIG. 1 shows a structural frame.

In FIG. 1 a structural frame of an image forming apparatus and the like is shown. As described previously, when this kind of structural frame is made from a resin, as FIG. 1 shows, in order to support positioning of respective printing devices with a high degree of accuracy as previously described, usually deformation of the structural frame is prevented by integrally forming from resin only side wall portions 1L, 1R which are mutually parallel, perpendicular to the rotational central axes of the respective printing devices and which serve as means for positioning the respective printing devices, and one connector 1*b* for connecting the side wall portions 1L, 1R and by using a plurality of highly rigid steel plate reinforcing members 18 to attach the side wall portions 1L, 1R. However, this kind of conventional structural frame has many areas in need of improvement as described previously.

Below, while referring to the drawings the present invention, which resolves the problems of the above-described conventional structural frame, will be described.

Figure 2:
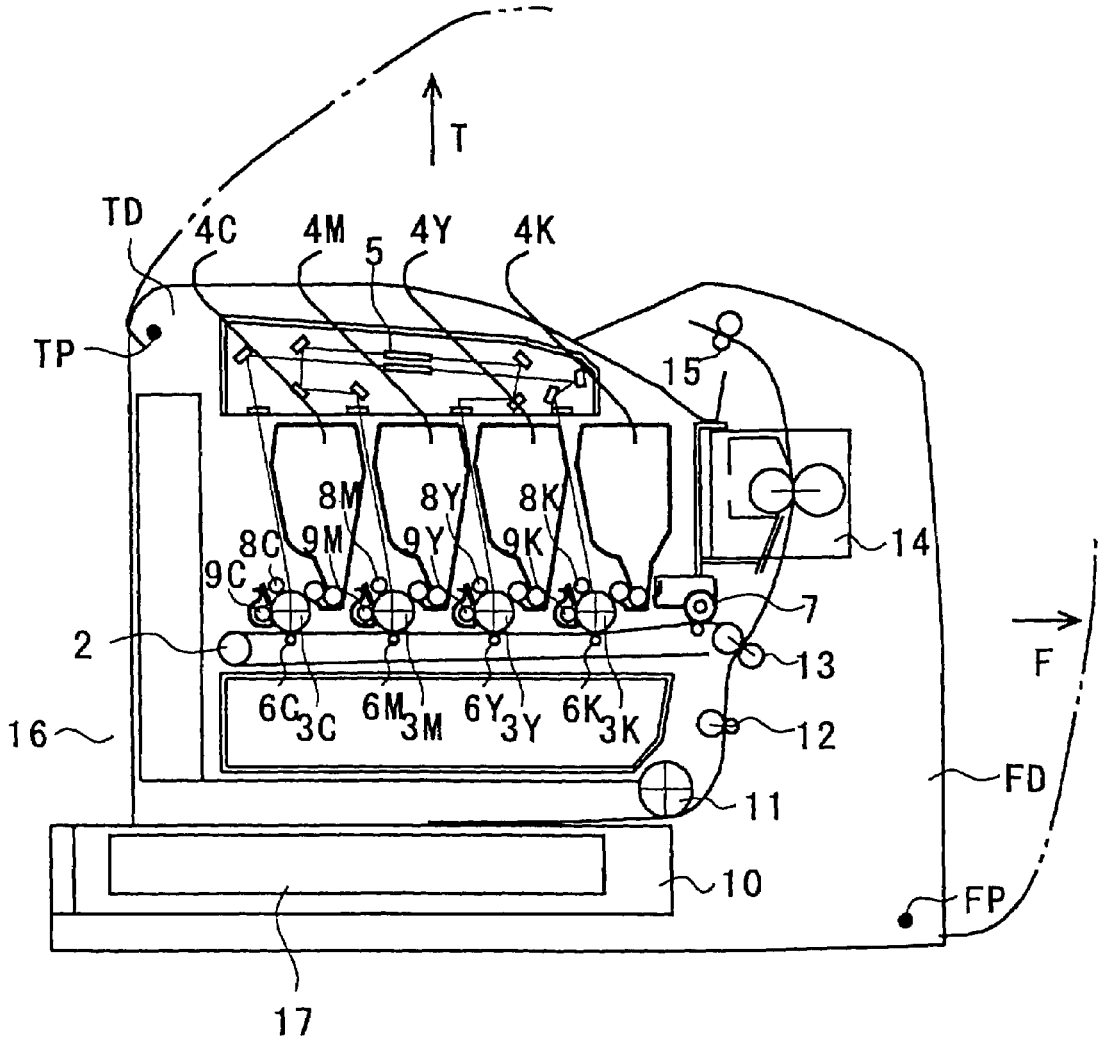
FIG. 2 shows the principal section of an image forming apparatus of an embodiment according to the present invention.

FIG. 2 centrally shows the structural frame 1 of an image forming apparatus of an embodiment according to the present invention and the positioning of each internal device. A belt-shaped intermediate transfer device 2 is stretched in a horizontal direction. On the upper portion of the belt-shaped intermediate transfer device 2, photoreceptor drums which are image forming devices 3K, 3Y, 3M, 3C are provided in a row in the rotational direction of the belt-shaped intermediate transfer device 2. On the upper portion of each image forming device 3 developing devices 4K, 4Y, 4M, 4C of four different colors are provided filled with toner of fine color powder. Furthermore, in the upper portion of each developing device 4 an exposure device 5 for forming electrostatic latent images on the image forming device 3 is provided.

In the area surrounding the belt-shaped intermediate transfer device 2, first transfer devices 6K, 6Y, 6M, 6C are provided on the lower portion of the respective image forming devices 3, whereby the belt-shaped intermediate transfer body is sandwiched between the image forming device 3 and the first transfer device 6. An intermediate transfer body cleaning device 7 is also provided in the area surrounding the belt-shaped intermediate transfer device 2. In the area surrounding each image forming device 3, an electrifier 8 and an image forming cleaning device 9 are provided. On the lower end of the belt-shaped intermediate transfer device 2 a recording medium holding device 10 for stopping the recording medium and a recording medium sending device 11 are provided. In the center right side of the drawing a recording medium supplying device 12, a second transfer device 13, a fixing device 14 and a recording medium discharge device 15 are provided.

In an operation of an image forming apparatus 16 of the present embodiment according to the above configuration, first the image forming device 3 which is a photoreceptor drum, is turned by means of a source of power (not shown in drawing) and the surface is uniformly electrified by means of the electrifier 8. Next, image or character information from a personal computer, image scanner or the like, is exposed in units of dots by exposure means 5, and a latent electrostatic image is formed on the surface of the image forming device 3. Afterwards, the electrostatic latent image on the image forming device 3 is supplied with toner and developed by the developing device 4, and thereby made visible as a toner image. Following this the toner image is transported to a first transfer position. At the first transfer position the toner image is transferred onto the surface of the belt-shaped intermediate transfer device 2 from the image forming device 3 by means of a difference in electric potential of the image forming device 3 and the first transfer device 6 supplied by a power supply (not shown in drawings). After the [toner image] has passed through the first transfer position, the surface of the image forming device 3 is cleaned by the image forming device cleaning means 9 of any toner remaining on the surface which did not transfer at the first transfer position, and thereby forming of the next toner image is made possible. By sequentially carrying out the above operation for the respective developing devices 4K, 4Y, 4M, 4C in sequence with the belt turning speed of the belt-shaped intermediate transferring device 2, a multi-color toner image of layered single color toner images is formed on the surface of the belt-shaped intermediate transfer device 2.

At the appropriate time a recording medium such as a paper, an OHP sheet or such is transported to a second transferring position by means of the recording medium supplying device 12, and the single color or multi-color toner image formed on the surface of the belt-shaped intermediate transfer device 2 is transferred onto the recording medium by the action of the second transfer device 13.

Afterwards, the recording medium is separated from the second transfer device 13, the toner is fixed onto the recording medium by the fixing device 14, and the recording medium is discharged from the image forming apparatus 16 by means of the recording medium discharge device 15. After the transferring of the toner image to the recording medium is completed, the remaining toner, which did not transfer and remained on the belt-shaped intermediate transfer device 2 is cleaned off by the intermediate transfer unit cleaning device 7 and thereby layering of the next toner image is possible.

The image forming apparatus 16 according to the above-described embodiment is characterized in that by forming the intermediate transfer device 2 as a belt shape, the plurality of image forming devices 3K, 3Y, 3M, 3C and developing devices 4K, 4Y, 4M, 4C are provided in a row and the transport pathway for the recording medium is simplified, whereby a compact and lightweight image forming apparatus 16 main body is realized.

Moreover, a sending direction of the recording material 17 corresponds with the back to front direction of the image forming apparatus 16, and by pulling out the recording medium holding device 10 in a front side F direction recording material replenishing is possible. Furthermore, a front door FD is capable of opening and closing by rotating at a central point of support FP, and a top door TD is also capable of opening and closing by rotating at a central point of support TP. Thus it is possible to replace developing devices 4K, 4Y, 4M, 4C containing no more toner, or an image forming device 3, by pulling such devices out in a top side T direction. It is also possible to replace the belt-shaped intermediate transfer device 2, intermediate transfer cleaning device 7, or fixing device 14 which are devices needing periodic replacement, by pulling such devices out in the front side F direction. Also, when recording medium jams the jammed recording medium may be removed by opening the front door FD. In this manner good usability is achieved. Furthermore, as opening and closing doors are not disposed on either side of the image forming apparatus 16, it is possible to place other items adjacently on the right and left sides of the image forming apparatus 16, place the image forming apparatus 16 in a corner of an office or such, or install the image forming apparatus 16 on a small space of a desk. Thus, not only is compactness of the image forming apparatus 16 achieved, but compactness of the required installation space is also realized.

In the image forming apparatus 16 according to the present embodiment, the advantages of compactness and reduction of weight are based on a basic concept of cost lowering, and as such it is also necessary to realize a low-cost structural frame for the inside of the image forming apparatus. In a conventional structural frame of an image forming apparatus usually a method for combining a plurality of steel plates, and attaching affixing parts of each device to these steel plates is used. However, when using this method, aside from an increase in weight due to the large number of parts, time and labor required for assembly is significant, and as such manufacturing costs increase.

Moreover, the image forming apparatus 16 according to the present invention demands a high degree of accuracy for the positioning support of the intermediate transfer device 2 as a belt is employed in the intermediate transfer device 2. Usually in an image forming apparatus, if a belt-shaped device is not positionally supported with a high degree of accuracy, speed fluctuation will occur due to deviation or slippage. As a result of this, image defects are caused as misalignment of color layering, image deformation and such are generated. Also as the image forming apparatus 16 according to the present invention, is a color image forming apparatus which can obtain color images by means of layering the multi-color toner images on top of the intermediate transfer device 2, rotational central axes of a plurality of rollers which the belt-shaped intermediate transfer body, which is the intermediate transfer device 2, spans over, require highly precise parallelism. If by modifying the structural frame the right and left side wall portions are but slightly deformed, the previously described parallelism of the axes becomes inaccurate, and as a result image defects are caused as misalignment of color layering, image deformation and such are generated.

In the image forming apparatus 16 according to the present invention, to improve usability as previously described, the front door FD and the top door TD are provided on the front surface and top surface respectively, such that it is possible to perform attaching and detaching of the respective printing devices embedded in the structural frame 1, and to remove paper jams. As a result of this, large aperture portions in the structural frame are necessary, and in order to obtain good image quality as previously described, obtaining a structure required for ensuring the essential rigidity of the structural frame is challenging.

The structural frame according to the present embodiment is composed as an integrated product of right and left side wall portions 1L, 1R formed by resin molding, which are mutually parallel and perpendicular to the rotational central axes of the respective printing devices, and is also composed from three connectors 1*b*, 1*t*, 1*r* formed from thin steel sheet for connecting the side wall portions 1L, 1R to each other. The present embodiment is configured by placing the side wall portions in substantially vertical directions sandwiching the respective printing devices, and joining the side wall portions and connectors with screws.

The present configuration will be explained in terms of the functions required thereof. The right and left side wall portions 1L, 1R require a complex formation in order to maintain the positioning and supporting of the internally mounted respective printing devices, as well as to maintain the positioning support of the plurality of parts and units such as the driving device, the power supply, a control substrate, and so on. By forming the right and left side wall portions 1L, 1R integrally, the above mentioned object can be achieved. On the other hand, strength is required of each individual connector 1*b*, 1*t*, 1*r* for maintaining rigidity of the complete structural frame 1, rather than for the maintaining of the positioning of parts and units. By composing the connectors 1*b*, 1*t*, 1*r* for connecting the side wall portions from thin steel plate a configuration which achieves the above mentioned object may be formed.

By integrally forming the right and left side wall portions 1L, 1R from resin a complex formation can be obtained, however, according to the present configuration the right and left side wall portions 1L, 1R are independent parts. Compared to the integrated configuration of the structure shown in previously described FIG. 2, the mold for molding the present configuration may be configured with two simple releasing directions, and as such there is no need for a complex mold structure. Therefore, according to the present embodiment, in addition to making the high degree of accuracy demanded for the positioning of the respective printing devices of the image forming apparatus easily obtainable, a reduction of design time and manufacturing time of the mold during the product manufacturing process is also achieved. As a result of this, manufactured products the market is demanded can be provided timely. Moreover, by forming the connectors 1*b*, 1*t*, 1*r* connecting the side wall portions from thin steel plate, compared to a configuration integrally formed from resin, rigidity of the structural frame 1 as a whole is easily obtained.

Figure 3:
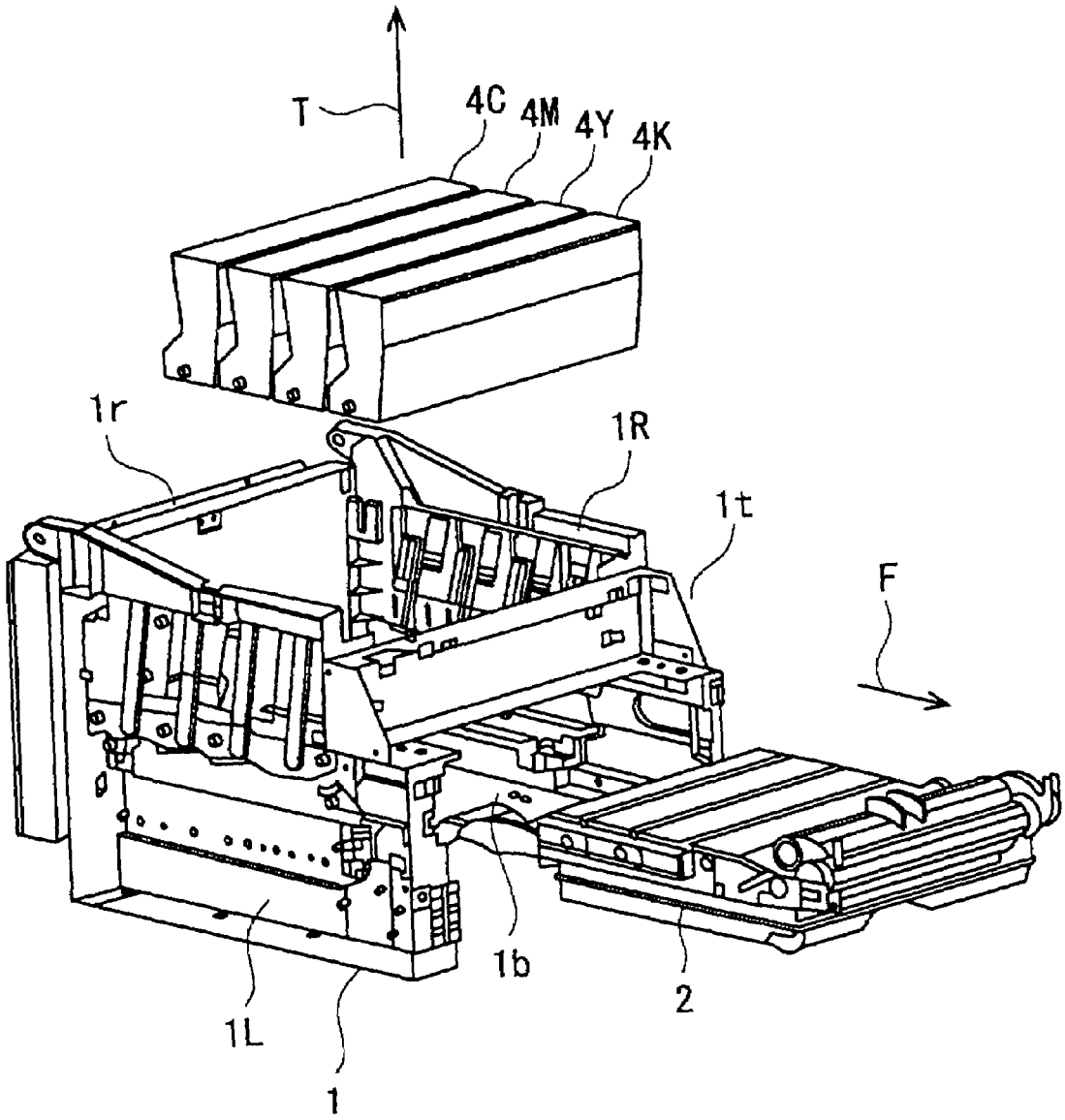
FIG. 3 shows the structural frame of the image forming apparatus.

FIG. 3 shows the structural frame of the present invention. As FIG. 3 shows, in the structural frame 1 which houses the respective printing devices, the right and left resin side wall portions 1L and 1R which support positioning of the respective printing devices and have mutually parallel surfaces, are disposed perpendicular to the rotational central axes of the respective printing devices. Also, a base connector 1*b*, an upper portion connector 1*t*, and a rear portion connector 1*r* for connecting the right and left side wall portions 1L, 1R to each other, are formed from steel plate and are provided shutting in the respective printing devices which require a high degree of accurate positioning support, in order to obtain high quality images as previously described such as the intermediate transfer device 2, the image forming device 3 and the developing device 4. The sidewall portions 1L, 1R and the connectors 1*b*, 1*t*, 1*r* are formed as box-like shapes opening outwardly from the image forming apparatus 16. The structural frame is configured as a formation in which the side wall portions 1L, 1R and the connectors 1*b*, 1*t*, 1*r* are combined. FIG. 3 shows the structural frame 1, and devices to which accurate positioning is especially important, such as the intermediate transfer device 2, the image forming device 3, and the developing device 4. Also in FIG. 3 the detaching/attaching direction of the intermediate transfer device 2 is shown as F and the detaching/attaching direction of the image forming device 3 and the developing device 4 is shown as T.

Figure 4:
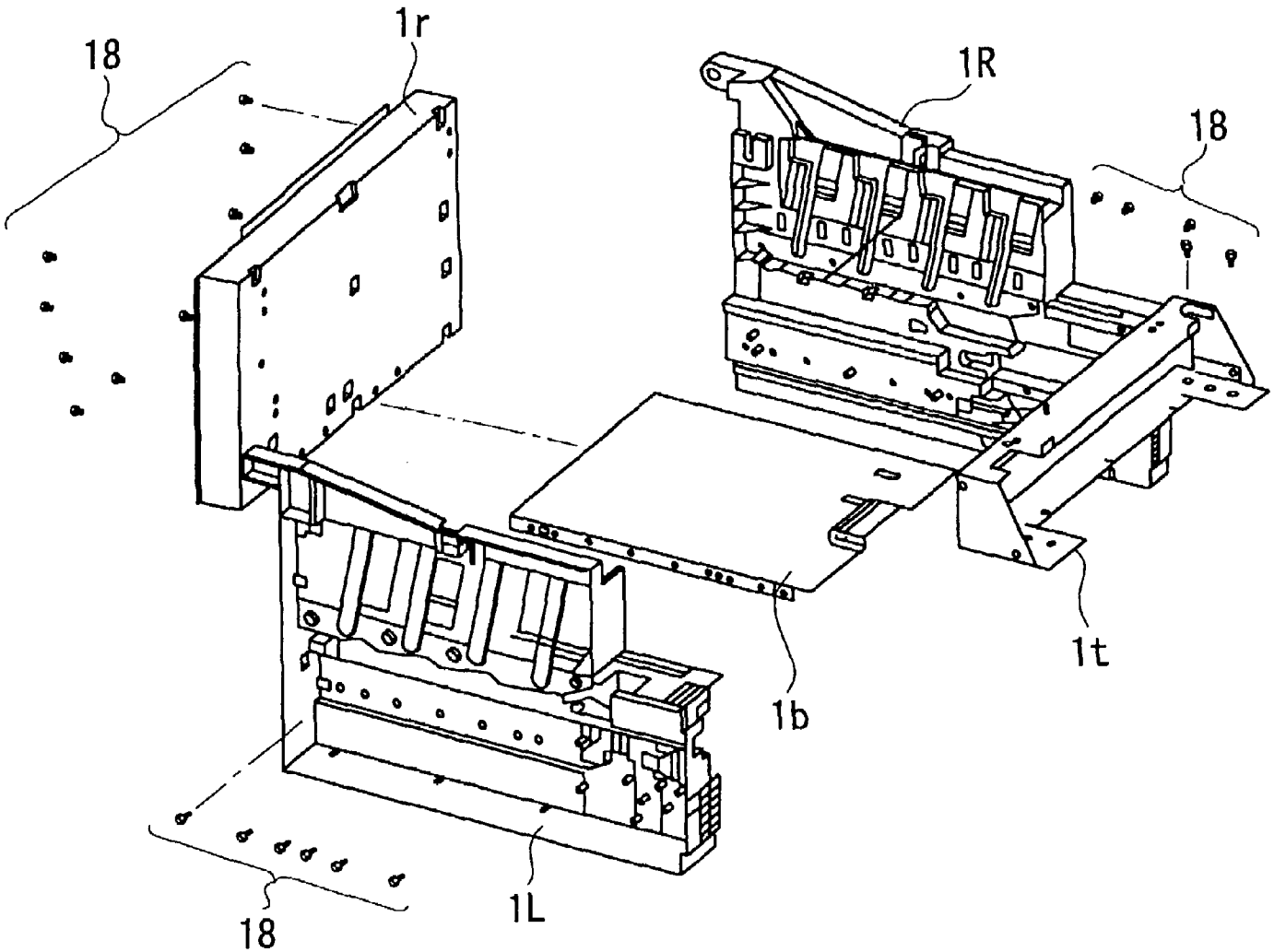
FIG. 4 shows an exploded schematic view of the structural frame.

FIG. 4 is an exploded schematic view of the structural frame of the present invention. In FIG. 4 the originally integrated structural frame 1 is separated by component parts, such that the side wall portions 1L, 1R and the connectors 1*b*, 1*t*, 1*r* are shown in an exploded schematic view. As the drawing shows, the developing device 4 can not only be smoothly removed in the T direction from the structural frame 1, but can also be accurately fixed in position without reducing the degree of accurate positioning support by means of the side wall portions 1L, 1R. Moreover, the intermediate transfer device 2 can not only be smoothly removed in the F direction from the structural frame 1, but can also be accurately fixed in position by means of the side wall portions 1L, 1R. Furthermore, by providing the recording medium holding device 10 underneath the connector 1*b*, deformation of the structural frame 1 is prevented and the structural frame 1 can be stabilized.

By configuring a structural frame such as that described above, while providing two large aperture portions in the front section and top section in order to improve usability, as an enclosed space is formed by assembling the side wall portions 1L, 1R and the connectors 1*b*, 1*t*, 1*r* having a box-like shape in the area around the respective printing devices to which accurate positioning support is important, a strong structural frame 1 can be configured.

By forming the side wall portions 1L and 1R as resin molded articles, rather than forming an integrated complex formation to function as positioning support for the respective printing devices, drive device, power supply, control substrate and the like, a significant reduction in the number of parts can be realized, and it is possible to significantly reduce the manufacturing costs of the image forming apparatus 16 as a whole. Moreover, by configuring the connectors 1*b*, 1*t*, 1*r*, from which rather than functioning as positioning support, strength is demanded, from thin steel plate, the rigidity demanded of the structural frame 1 is easily obtained, and additionally the number of parts are reduced. Therefore, it is possible to reduce the weight of the image forming apparatus 16 as a whole.

However, in order to realize the rigidity needed to maintain the high degree of accurate positioning support required by the image forming apparatus according to the present configuration, strength is also needed in the side wall portions. This strength can be easily obtained by devising joining means for joining the side wall portions and the connectors. In other words, the structural frame 1 of the image forming apparatus 16 according to the present invention, is configured such that the end portions of the surfaces of the side wall portions 1L, 1R and the connectors 1*b*, 1*t*, 1*r*, in other words vertical rib portions of the outer periphery of the box-like shapes, are configured to be substantially flush. As the image forming apparatus 16 of the present invention is a color image forming apparatus, highly precise parallelism is required for the plurality of rollers on which the image forming device 3 and belt-shaped intermediate transferring body span, and the rotational central axis of the intermediate transfer device 2. If there is an inaccuracy in the degree of parallelism between the axes of the right and left sidewall portions 1R, 1L, a misalignment in the layering of color is generated and image defects are caused.

The actual weight of the image forming apparatus 16 is only 20 kg. The difference in weight when toner and paper are fully loaded and when the toner and paper are empty is approximately 2.5 kg and thus exceeds ten percent of the total weight. Due to this the fluctuation of the center of gravity when in use is intense, and balance of the reaction force added from the legs of the installation surface easily deteriorates. Therefore, in order to ensure the degree of parallelism between the axes against the twisting deformation previously described, the box-like shaped outer peripheral vertical rib portions of [the respective plates and connectors] are positioned close to each other, such that stress generated in the structural frame 1 due to external force is effectively transmitted and dispersed as much as possible. In this manner deformation of the structural frame 1 can be reduced. Moreover, when screws, rivets or other such point fasteners, are used in joining means for joining the side wall portions and the connectors, so that stress due to external forces and the like, is efficiently transferred to the side wall portions and connectors, it is preferable to position joining points with a minimum distance between two adjacent joining points of no less than 30 mm and no more than 80 mm.

Furthermore, when the present invention is employed, it is preferable that the spacing between the side wall portions 1L, 1R for supporting positioning of the respective printing devices in the structured frame 1, be no less than 220 mm and no more than 350 mm. If spacing exceeds 350 mm it is difficult to ensure rigidity especially against twisting. However, it is possible to deal with this by increasing the standard resin plate thickness and such, but this causes such adverse effects as increases in material used and a degrading of formability. Accordingly, in this case it is preferable to position a reinforcement member composed of steel plate adjacent to a connector. As a result of this, while the number of parts increases and the time required for assembly increases dramatically, an image forming apparatus which in addition to employing the present invention, can handle larger sized printing medium can be provided.

Therefore, according to the present invention it is possible to provide an image forming apparatus which prevents deformation of a structural frame caused by external force or weight of the apparatus itself, when set on a surface such as a conventional desk or floor, prevents image defects such as image deformation and the like without reducing the degree of accuracy of positioning support of respective printing devices inside the image forming apparatus, and furthermore also makes precise color matching possible while also being low price, easily assembled, compact, lightweight, highly reliable, and capable of obtaining high quality images.

If, in the present invention, positioning support of a high degree of accuracy is not implemented, variation in speed due to deviation, slippage and such will occur, and image defects will be generated. This is especially so when a belt device is used as an image forming device or intermediate transfer device for the image forming apparatus.

As described above, in the present invention, by using resin to form the side wall portions, a complex formation can be molded, and as such the functions of positioning/holding the respective printing devices, driving device, substrate and so on can be consolidated. Moreover, by forming the connectors from thin steel plate, rigidity of the structural frame can be obtained. Furthermore, as the two side plates are independent parts, a mold can be configured with two simple releasing directions, and thereby positioning parts of the respective printing devices can be produced with a high degree of accuracy.

Also, by attaching steel stays to the right and left resin frames in substantially horizontal and substantially perpendicular directions to form the frame in a box-like shape, greater torsional rigidity can be obtained. As a result of this, color misalignment due to twisting of the frame can be reduced. Furthermore, by forming the aperture portions in two directions, a user can replace expended supplies and clear paper jams from the front of the machine, without going around to the rear of the machine.

In the present invention, by positioning both side plates facing each other, and joining both side plates with connecting members in two or more places, a substantially box-like frame is assembled. Both side plates are made of resin, and the connecting members are made of steel plate. By forming both side plates from resin, it is possible to construct a complex formation. When conventional side plates of steel plate are used, position parts for each unit are required, however it is possible to form these integrally. Thus, it is possible to cut down on the number of parts and the cost of the mold, and as such costs can be reduced.

When mounting positioning parts for each unit on both steel plate side plates, mounting errors do occur. However, as by integrally forming both side plates, mounting errors do not occur, highly accurate unit positioning is possible.

Furthermore, the intermediate transfer device is positioned inside the frame, and the belt is spanned across two or more rollers. When the roller axes are not parallel the belt twists resulting in discoloration, and damage. Due to this, a high degree of accuracy is demanded of the parallelism between the axes. This accuracy can be obtained by forming both side wall portions from resin and configuring the parts integrally, such that the stack-up tolerance is lessened.

Moreover, in regards to machine maintenance, there are cases of conventional machine in which the connectors must be removed from the rear side of the machine when removing a jam as the transport device is joined to the frame. While in the present invention, as aperture portions of the frame are provided on the front surface and top surface, and a transport pathway is set in the machine front side, jam removal can be carried out from the front surface of the machine, and expended supplies can be replaced from the top surface side. As a result of this a user can remove jams and replace expended supplies without having to go around to the rear side of the machine, and without having to remove the connectors.

According to the present invention it is possible to provide an image forming apparatus which prevents deformation of a structural frame caused by external force or weight of the apparatus itself, when set on a surface such as a conventional desk or floor, prevents image defects such as image deformation and the like without reducing the degree of accuracy of positioning support of respective printing devices inside the image forming apparatus, and furthermore also makes precise color matching possible while also being low price, easily assembled, compact, lightweight, highly reliable, and capable of obtaining high quality images.

Various modifications will become possible for those skilled in the art after receiving the teachings of the present disclosure without departing form the scope thereof.

What is claimed is:

1. An image forming apparatus comprising:

an image forming unit for forming an image on a recording medium, the image forming unit including, as printing devices, an image forming device for holding and transporting an electrostatic latent image, an exposing device for forming an electrostatic latent image on said image forming device, at least one of a single and a plurality of developing devices for supplying a developer to said image forming device and visualizing an electrostatic latent image, and at least one of an intermediate transfer device located adjacent to said image forming device, the intermediate transfer device configured to superimpose an image formed on said image forming device onto a surface of said intermediate transfer device, and a transfer device configured to transport said recording medium and transfer an image formed on said intermediate transfer device onto said recording medium;

a driving device for driving said respective printing devices;

a power supply for supplying a predetermined voltage to said respective printing devices and said driving device and performing an image forming operation;

a control substrate for performing control of said image forming operation; and a structural frame for supporting said image forming unit, said structural frame includes side wall portions formed from resin and provided on both sides of said image forming apparatus, and at least two connectors formed from a metal, for joining said side wall portions, said image forming unit being supported by said side wall portions, and said connectors joining said side wall portions in substantially perpendicular and substantially horizontal directions, wherein said structural frame is configured to house any one of said respective printing devices, supporting, or supporting via holding members, said respective printing devices, and supporting, or supporting via holding members, said driving device, said power supply and said control substrate, and said side wall portions have mutually substantially parallel surfaces substantially perpendicular to rotational central axes of said respective printing devices, and said connectors join said side wall portions to each other in at least two places, said connectors being provided in a substantially vertical direction in said image forming apparatus sandwiching any one of the said respective printing devices, and being formed from thin steel plate, said side wall portions being formed integrally in a box-like shape from resin, and said side wall portions and said connectors being joined by a joining device.

2. The image forming apparatus as claimed in claim 1, wherein said image forming device or said intermediate transfer device is embedded in said structural frame, and is configured by a belt spanning across two or more rollers.

3. The image forming apparatus as claimed in claim 1, wherein said structural frame is further configured with said side wall portions and said connectors adjacent to each other, and is provided with an aperture portion in at least two places for detaching/attaching said respective embedded printing devices, or for removing a jammed recording medium.

4. The image forming apparatus as claimed in claim 1, wherein said sidewall portions and said connectors in said structural frame are joined by screws, and screw joining points are positioned with a minimum distance between two adjacent screw joining points of no less than 30 mm and no more than 80 mm.

5. The image forming apparatus as claimed in claim 1, further comprising a reinforcing rib for forming a substantially box-like shape adjacent to the periphery of the surfaces substantially perpendicular to said rotational central axes of said respective printing devices of said side wall portions, wherein said reinforcement rib has a height of no less than 10 mm and no more than 70 mm, a thickness of no less than 1 mm and no more than 3 mm, and is provided continuously along said periphery.

6. The image forming apparatus as claimed in claim 1, wherein said side wall portions are spaced no less than 220 mm and no more than 350 mm apart.

* * * * *